US009546851B2

(12) United States Patent
Kim

(10) Patent No.: US 9,546,851 B2
(45) Date of Patent: Jan. 17, 2017

(54) LIGHTED ARROW NOCK

(71) Applicant: Jae Woo Kim, Seongnam-si (KR)

(72) Inventor: Jae Woo Kim, Seongnam-si (KR)

( * ) Notice: Subject to any disclaimer, the term of this patent is extended or adjusted under 35 U.S.C. 154(b) by 0 days.

(21) Appl. No.: 14/679,295

(22) Filed: Apr. 6, 2015

(65) Prior Publication Data

US 2015/0308798 A1 Oct. 29, 2015

(30) Foreign Application Priority Data

Apr. 29, 2014 (KR) ..... 10-2014-0051506

(51) Int. Cl.
*F42B 6/06* (2006.01)
*F42B 12/38* (2006.01)

(52) U.S. Cl.
CPC ..... *F42B 6/06* (2013.01); *F42B 12/382* (2013.01)

(58) Field of Classification Search
CPC ..... F42B 6/04; F42B 6/06
See application file for complete search history.

(56) References Cited

U.S. PATENT DOCUMENTS 4,547,837 A * 10/1985 Bennett ..... F42B 6/06 200/60
6,736,742 B2 * 5/2004 Price et al. ..... F42B 12/382 473/570
7,021,784 B2 * 4/2006 DiCarlo ..... F21V 33/008 362/109
7,837,580 B2 * 11/2010 Huang et al. ..... F42B 6/06 473/570
9,279,649 B2 * 3/2016 Bay ..... F42B 6/06
2016/0010961 A1 * 1/2016 Marshall, Jr. ..... F42B 12/382 473/570

* cited by examiner

*Primary Examiner* — John Ricci
(74) *Attorney, Agent, or Firm* — Cantor Colburn LLP

(57) ABSTRACT

A lighted arrow nock capable of easily turning on or off a light, and being easily connected to an arrow shaft includes a light emitting unit including a light and a battery and turning on or off the light by moving the light toward the battery or away from the battery; an arrow adaptor which includes a cylindrical structure so that an outer surface is inserted into a rear end of an arrow, in which the battery is inserted into an inner space of the arrow adaptor; and a light operator which is inserted in an upper portion of the arrow adaptor, while a lower portion of the light operator receives the light, and is moved up and down to turn on or off the light in a state in which the light operator is inserted in the arrow adaptor.

4 Claims, 8 Drawing Sheets

LIGHTED ARROW NOCK

BACKGROUND OF THE INVENTION

Field of the Invention

The present invention relates to an arrow nock, and, more specifically, to a lighted arrow nock capable of easily turning on or off a light, and being easily connected to an arrow shaft.

Background of the Related Art

In general, an arrow 1 used for archery includes, as illustrated in FIG. 1, an arrow shaft 10 of a cylindrical cross section made of duralumin, glass fiber, carbon fiber, or the like to form a body, an arrowhead 20 fitted to a front end of the arrow shaft 10, feathers 30 designed to stabilize flight of the arrow 1 and to keep the arrow pointed in the direction of travel, and a nock 40 which is a notch in the rearmost end of the arrow and serves the arrow in place on the string as a bow is being drawn.

There has been recently developed a technology of providing the arrow with a lighting function in order to enable a user to effectively enjoy the archery even at night or on a cloudy day. In this instance, a light and a battery are provided to the rear end of the arrow, that is, the nock 40, and the light is turned on or off, so that the lighted arrow can be used.

SUMMARY OF THE INVENTION

The lighted arrow of the related art has problems in that the structure of turning on or off the light is complicated, and a device sensitive to on/off operation should be employed.

Therefore, the present invention has been made in view of the above problems, and an object of the present invention is to provide a lighted arrow nock capable of being conveniently turning on or off a light, and being easily connected to an arrow.

according to one aspect of the present invention, there is provided a lighted arrow nock including: a light emitting unit including a light and a battery and turning on or off the light by moving the light toward the battery or away from the battery; an arrow adaptor which includes a cylindrical structure so that an outer surface is inserted into a rear end of an arrow, in which the battery is inserted into an inner space of the arrow adaptor; and a light operator which is inserted in an upper portion of the arrow adaptor, while a lower portion of the light operator receives the light, and is moved up and down to turn on or off the light in a state in which the light operator is inserted in the arrow adaptor.

Preferably, the light emitting unit consists of the battery of a cylindrical shape, and the light provided integrally with an upper end of the battery and turned on or off by upward and downward movement of the light operator.

Preferably, the arrow adaptor includes an arrow engaging portion which has an insertion portion formed on an outer surface of a lower portion of the arrow adaptor and inserted in a rear end of an arrow shaft, and a locking shoulder formed on the outer surface; a battery insertion hole which is formed in an inner surface of the arrow adaptor and receives the battery therein; and an operator engaging hole which is formed in an inner surface of an upper portion of the battery insertion hole and is engaged to a top surface of the light operator to be able to move up and down.

Preferably, the arrow engaging portion further includes an arrow insertion reinforcing portion which is formed by cutting a wall of the arrow adaptor, and has a thickness thicker than other wall of the arrow adaptor.

Preferably, the light operator includes a light insertion groove which is formed on an inner surface of a lower portion of the light operator, so that the light is not easily released from an inserted state; an adaptor insertion portion which is formed on an outer surface of the light operator and is inserted into the operator engaging hole; a guide rail which is formed on one side of the adaptor insertion portion to guide the light operator toward the operator engaging hole; and a position restricting portion which is formed at a position opposite to the guide rail of the adaptor insertion portion, and restricts movement of the light operator inserted in the operator engaging hole to ON and OFF positions so as to turn on or off the light.

The light emitting unit may include a battery of a cylindrical shape which has a terminal protruding upwardly from an upper portion; and a light which is separated from the battery, and has first and second contact terminals protruding downwardly, in which the first contact terminal is provided to be brought into contact with an outer peripheral surface of the cylindrical battery, and the second contact terminal is brought into contact with the terminal of the battery or being away from the terminal.

With the configuration described above, since the ON/OFF operation of the lighted arrow nock is performed by the simple manipulation, such as pressing or pulling, of the light operator, the present invention has an advantage of easy use. Also, since the nock consists of the arrow adaptor and the light operator, the nock is firmly engaged to the arrow shaft, and the light is easily operated. In addition, since the battery is provided integrally with the light, the configuration is simple, and additional wiring is not necessary.

DESCRIPTION OF SYMBOLS

Figure 1:
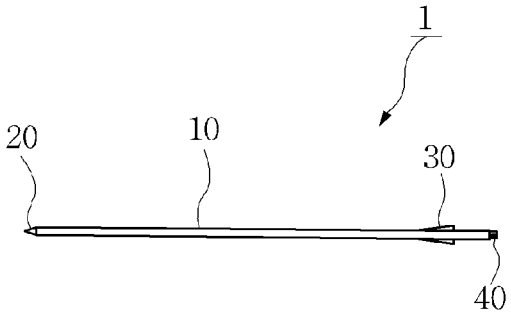
FIG. 1 Prior Art
FIG. 1 is a view illustrating a structure of a common arrow.

1: Arrow
10: Arrow shaft
20: Arrowhead
40: Nock
100: Lighted arrow nock according to first embodiment
110: Light emitting unit
120: Arrow adaptor

130: Light operator

200: Lighted arrow nock according to second embodiment

210: Light emitting unit

220: Arrow adaptor

230: Light operator

DETAILED DESCRIPTION OF THE PREFERRED EMBODIMENT

Preferred embodiments of the present invention will be hereafter described in detail with reference to the accompanying drawings.

First Embodiment

Figure 2:
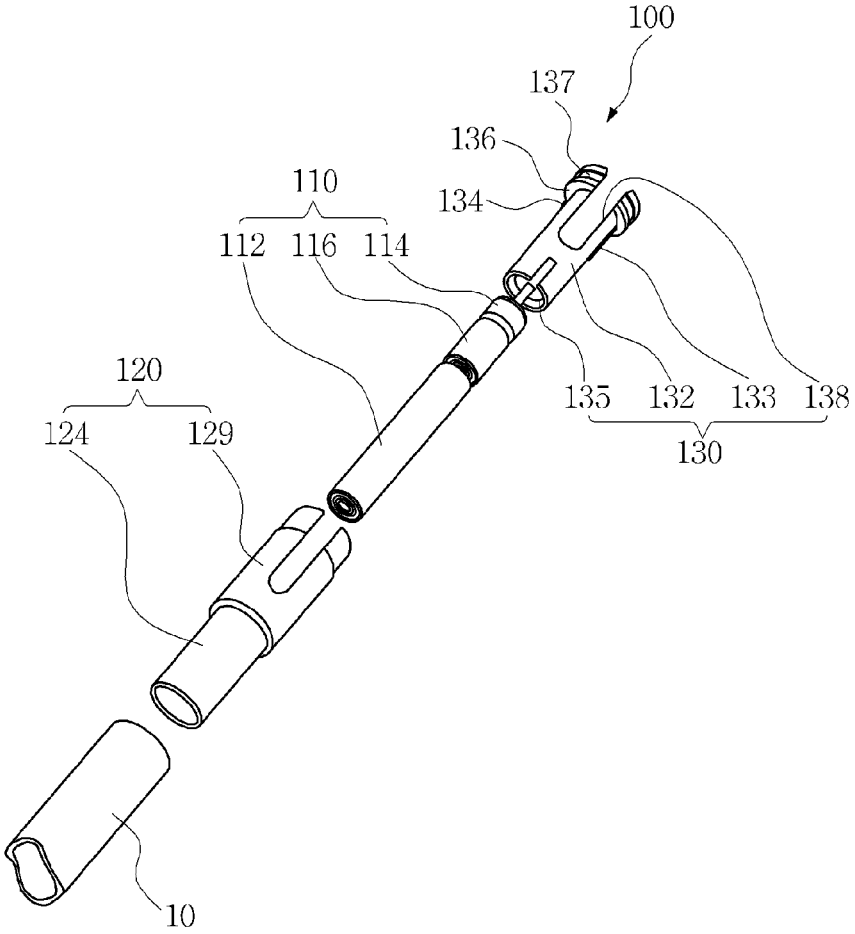
FIG. 2 is an exploded perspective view of a lighted arrow nock according to an embodiment of the present invention.

A lighted arrow nock 100 according to the embodiment includes, as illustrated in FIG. 2, a light emitting unit 110, an arrow adaptor 120, and a light operator 130.

Figure 5:
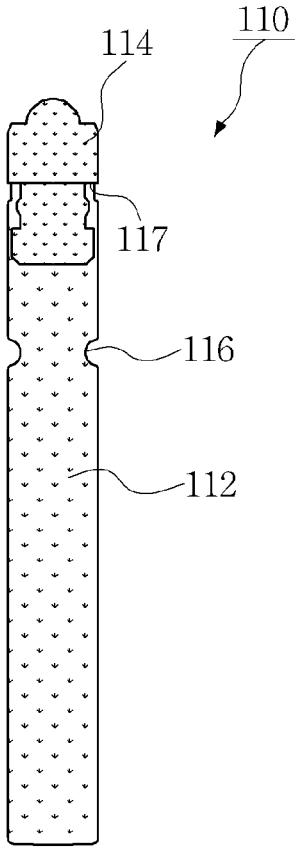
FIG. 5 is a cross-sectional view illustrating a structure of a battery integrally connected to the light according to the embodiment of the present invention.

First, the light emitting unit 110 has a battery provided integrally with a light. Specifically, the light emitting unit 110 may have, as illustrated in FIGS. 2 and 5, a battery 112 positioned at a lower portion and a light 114 positioned at an upper portion. The battery 112 positioned at the lower portion is formed in a cylindrical shape, and the light 114 is connected to an upper portion of the battery 112. As the light 114 is pushed toward the battery 112, the light 114 is turned on. As the light 114 is pulled away from the battery 112, the light is turned off.

As illustrated in FIGS. 2 and 5, a middle portion of the battery 112 is preferably provided with a protrusion insertion groove 116 to receive a protrusion 127*a* of the arrow adaptor 120, as described below, and the protrusion insertion groove 116 is formed on the outer surface of the battery 112 like a band.

As illustrated in FIG. 5, the light 114 preferably has a shoulder portion 117 on the surface facing the battery 112. This is to be firmly locked to the light operator 130 so as not to be released from the light operator when the light is turned on or off by the light operator 130 as described below.

The arrow adaptor 120 has the cylindrical structure so that the outer surface is inserted on a rear end of the arrow shaft 10, as illustrated in FIG. 2. The arrow adaptor 120 is configured in such a way that the light emitting unit 110 is inserted into the inner space of the arrow adaptor in a state in which the light 114 is exposed. That is, in this embodiment, the arrow adaptor 120 is an element for connecting the lighted arrow nock 100 itself to the arrow shaft 10 in the state in which the light emitting unit 110 is inserted, and the light operator 130 is also fastened to the arrow adaptor 120.

Figure 3:
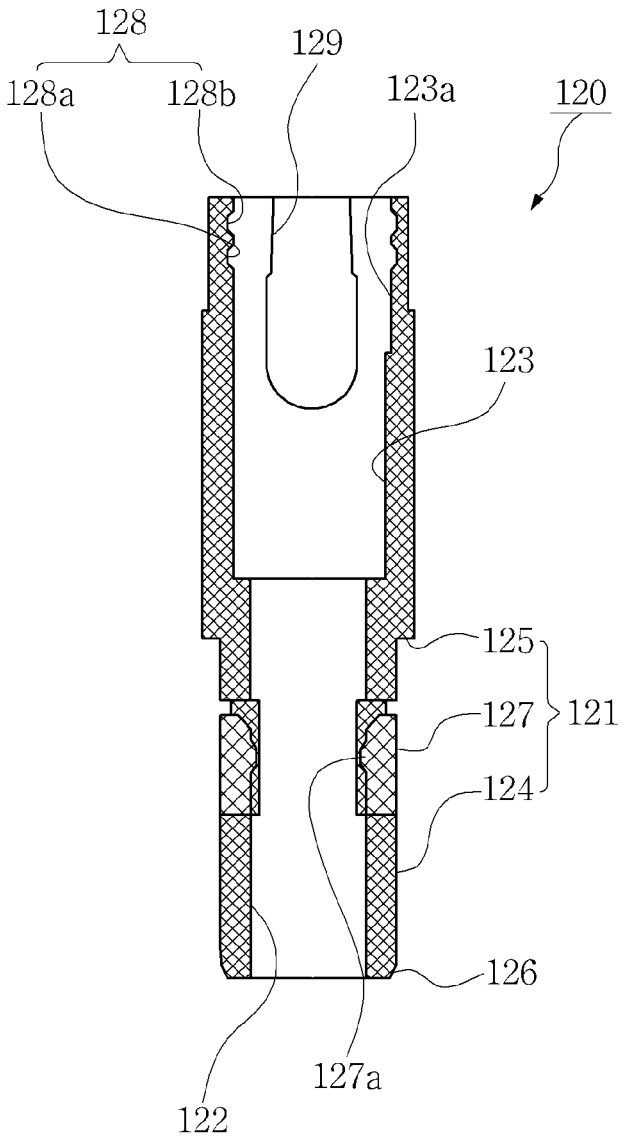
FIG. 3 is a cross-sectional view illustrating a structure of an arrow assembly according to a first embodiment of the present invention.

To this end, the arrow adaptor 120 of the embodiment has, as illustrated in FIGS. 2 and 3, an arrow engaging portion 121, a battery insertion hole 122, and an operator engaging hole 123.

First, the arrow engaging portion 121 is formed on an outer lower portion of the arrow adaptor 120. Specifically, the arrow engaging portion 121 has, as illustrated in FIG. 3, an insertion portion 124 of a diameter which can be inserted in the arrow shaft 10, and a locking shoulder 125 which is locked to the top surface of the arrow shaft 10 in a state in which the insertion portion 124 is inserted by a given depth. Also, the bottom surface of the arrow engaging portion 121 is preferably formed so that an outer corner 126 is tapered or chamfered, as illustrated in FIG. 3, for the purpose of being easily inserted into the arrow shaft 10.

In this embodiment, the arrow engaging portion 121 may further have an arrow insertion reinforcing portion 127 for reinforcing the insertion state, so that the arrow adaptor 120 is not released from the arrow shaft 10. The arrow insertion reinforcing portion 127 is provided on a portion which is formed by cutting a desired middle portion of a wall of the arrow engaging portion 121, as illustrated in FIG. 3.

A lower end of the arrow insertion reinforcing portion 127 is not cut, and is attached to the arrow adaptor 120. The remaining portion of the arrow insertion reinforcing portion 127 can be resiliently moved around the cut portion as an axis. Also, the inner surface of the arrow insertion reinforcing portion 127 is formed with a protrusion 127*a* protruding inwardly more than the inner surface of the arrow adaptor 120.

The protrusion 127*a* is pushed outwardly by the battery 112 which is inserted into the arrow adaptor 120, and the arrow insertion reinforcing portion 127 is pushed by the inner surface of the arrow shaft 10. Therefore, the arrow insertion reinforcing portion 127 is resiliently compressed between the battery 112 and the arrow shaft 10, and the arrow adaptor 120 is not released from the arrow shaft 10.

Figure 6:
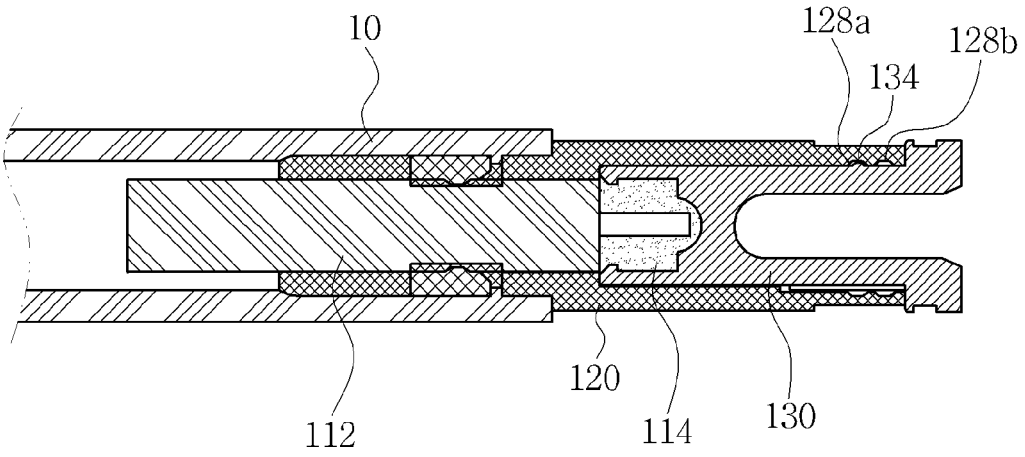
FIGS. 6 and 7 are views illustrating an operating state of the lighted arrow nock according to the embodiment of the present invention.
Figure 7:
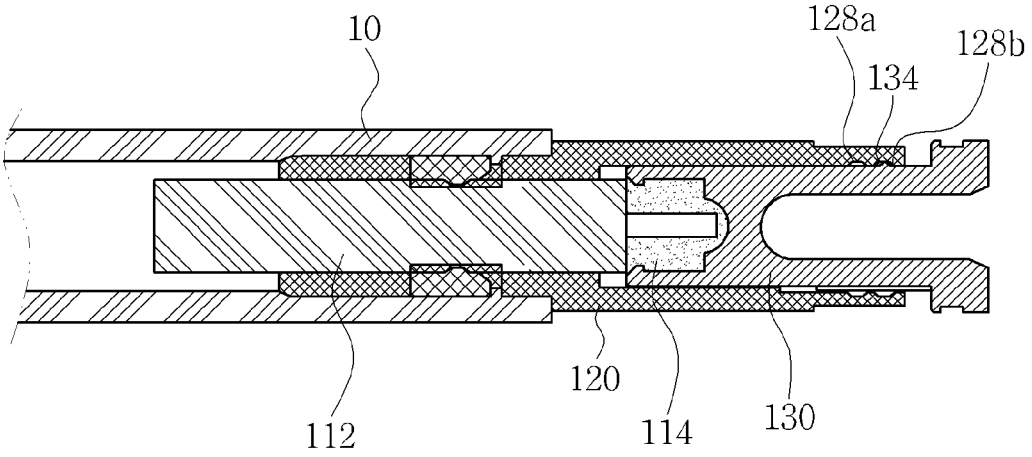

In the state in which the arrow adaptor 120 is completely inserted into the arrow shaft 10, as illustrated in FIGS. 6 and 7, the protrusion 127*a* is positioned in the protrusion insertion groove 116, and thus the battery and the arrow adaptor 120 are not released from the arrow shaft 10.

The battery insertion hole 122 is formed on the inner surface of the arrow engaging portion 121, as illustrated in FIG. 3, and the light emitting unit 110 is inserted in the battery insertion hole 122 in the state in which the battery is inserted into the light operator 130. To this end, the battery insertion hole 122 has almost the same inner diameter as the outer diameter of the battery so that the battery 112 of the cylindrical shape can be inserted in a contact state. Therefore, the battery 112 to be inserted into the battery insertion hole 122 enters while pushing the protrusion 127*a* outwardly, and compresses the arrow insertion reinforcing portion 127 in the inner space of the arrow shaft 10. As described above, the protrusion 127*a* is inserted into the protrusion insertion groove 116 to complete the firm engagement with the arrow shaft 10.

The operator engaging hole 123 is formed in the upper portion of the battery insertion groove 122, as illustrated in FIG. 3, and the lower portion of the light operator 130 is engaged to the operator engaging hole 123 to be able to move up and down. That is, a portion of the light operator 130 is inserted into the operator engaging hole 123, and can move up and down in the inserted state.

To this end, the operator engaging hole 123 has a diameter slightly larger than that of the battery insertion hole 122, and the upper portion of the operator engaging hole 123 is formed with an ON/OFF groove 128, and a position restricting portion 134 of the light operator 130 which will be described later. The ON/OFF groove 128 has two grooves spaced apart from each other in a vertical direction at a given interval, as illustrated in FIG. 3. Specifically, the grove formed at a lower side is an ON groove 128*a*, and the groove formed at an upper side is an OFF groove 128*b*. The operation thereof will be described in detail with reference to the light operator 130.

The operator engaging hole 123 is formed with a rail groove 123*a* in which a guide rail 133 of the light operator 130 is inserted, as illustrated in FIG. 3. The rail groove 123*a* is formed from the top surface of the arrow adaptor 120 to the lower portion at a given depth, and has a size to receive the rail 133. Accordingly, as the rail 133 is inserted in the rail groove 123*a* in the process of inserting the light operator 130 into the operation engaging hole 123, the light operator 130 is inserted at a correct position.

The arrow adaptor 120 is formed with a string nocking groove 129 for catching a string in place, when the lighted arrow nock 100 according to this embodiment is engaged to the arrow.

As illustrated in FIGS. 2 and 6, the light 114 inserted in the arrow adaptor 120 is inserted into the lower portion of the light operator 130, and the arrow adaptor 120 is moved in the vertical direction in the state of being inserted into the upper portion of the arrow adaptor 120 to turn on or off the light 114. That is, in this embodiment, the light operator 130 turns on or off the light 114 provided on the light emitting unit 110 inserted into the arrow adaptor 120.

Figure 4:
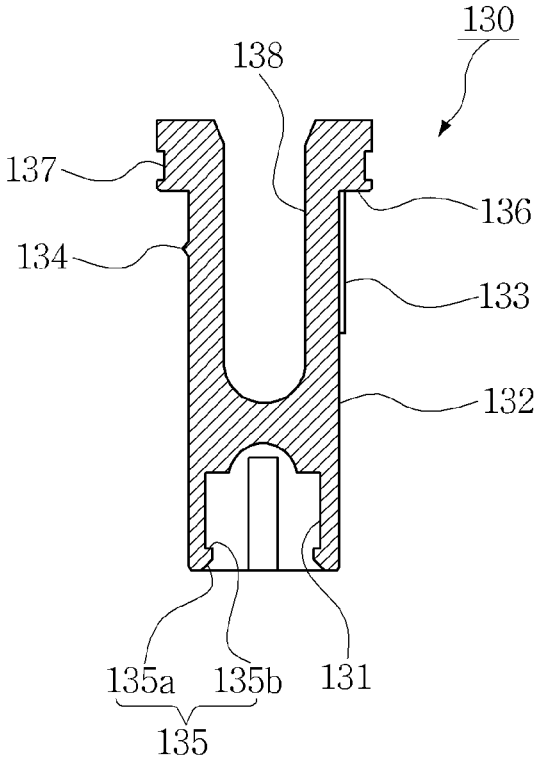
FIG. 4 is a cross-sectional view illustrating a structure of a light operator according to the embodiment of the present invention.

To this end, the light operator 130 of this embodiment may have a light insertion groove 131, an adaptor insertion portion 132, the guide rail 133, and the position restricting portion 134, as illustrated in FIG. 4.

First, the light insertion groove 131 is formed on the inner surface of the lower portion of the light operator 130, as illustrated in FIG. 4, so that the light 114 is not easily released from the inserted state. Accordingly, the light insertion groove 131 is formed with a locking portion 135 at the lower portion thereof to lock the light 114 to be inserted. The locking portion 135 has an inclined surface 135*a* on a lower portion thereof, and a shoulder 135*b* on an upper portion thereof, so that the light 114 is easily inserted, and is not easily released after insertion. The locking portion 135 is brought into contact with the shoulder portion 117 of the lower portion of the light 114 to prevent malfunction of the light 114 when the ON/OFF operation.

Preferably, the general shape of the light insertion groove 131 corresponds to the shape of the light 114, as illustrated in FIG. 4.

The operator insertion portion 132 is formed on the outer surface of the light operator 130, as illustrated in FIG. 2, and is inserted into the operator engaging hole 123. Accordingly, the operator insertion portion 132 has the size to be inserted into the operator engaging hole 123 of the arrow adaptor 120, and the upper portion of the adaptor insertion portion 132 is formed with a locking shoulder 136 to which an upper end of the arrow adaptor 120 is locked. Therefore, the adaptor insertion portion 132 is prevented from lowering beyond the locking shoulder 136 not to be inserted into the arrow adaptor 120.

The guide rail 133 is formed on one side of the adaptor insertion portion 132, as illustrated in FIG. 4 to guide the light operator 130 toward the operator engaging hole 123. The guide rail 133 is formed at a position opposite to the position restricting portion 134 to guide the correct insertion of the light operator 130 so that the position restricting portion 134 can be positioned at the correct position. Specifically, the guide rail 133 is elongated in a longitudinal direction of the light operator 130, and is inserted in the rail groove 123*a* formed on the arrow adaptor 120 to guide the correctly inserting direction of the light operator 130.

The position restricting portion 134 is formed at a position opposite to the guide rail 133 of the adaptor insertion portion 132, as illustrated in FIG. 4, and restricts the movement of the light operator 130 inserted in the operator engaging hole 123 to the ON and OFF positions so as to turn on or off the light 114. Herein, the ON position is a position where the light 114 is pushed toward the battery 112, as illustrated in FIG. 6, and the OFF position is a position where the light 114 is pulled away from the battery 112, as illustrated in FIG. 7.

That is, the position restricting portion 134 is configured to guide the light operator 130 to the correct positions to turn on or off the light 114 when the light operator 130 moves the light 114 toward the battery 112 or away from the battery 112 in the state the light operator 130 is engaged to the light 114.

Specifically, the position restricting portion 134 protrudes from the outer surface of the adaptor insertion portion 132 which is opposite to the guide rail 133, as illustrated in FIGS. 2 and 4, and is fitted to the ON/OFF groove 128 to restrict the position of the light 114, so that the light 114 is positioned at the ON position or the OFF position.

That is, as illustrated in FIG. 6, if the position restricting portion 134 is fitted to the ON groove 128*a* (i.e., positioned at the ON position), the light 114 is pushed toward the battery 112, and thus is turned on. On the contrary to this, as illustrated in FIG. 7, if the position restricting portion 134 is fitted to the OFF groove 128*b* (i.e., positioned at the OFF position), the light 114 is pulled away from the battery 112, and thus is turned off.

In this instance, the position of the position restricting portion 134 is changed by pressing the light operator 130 toward the arrow adaptor 120 or pulling the light operator 130 away from the arrow adaptor 120 in a state in which the upper portion is held by a hand of a user. To this end, the upper end of the light operator 130 may be formed with a holding groove 137 so that a nail of the user is easily inserted not to be slid, as illustrated in FIG. 4.

The light operator 130 of this embodiment may be formed with a string nocking notch 138 for receiving the string as the bow is being drawn, like the arrow adaptor 120.

Second Embodiment

A lighted arrow nock 200 according to this embodiment includes a light emitting unit 210, an arrow adaptor 220, and a light operator 230, similar to the first embodiment.

Figure 8:
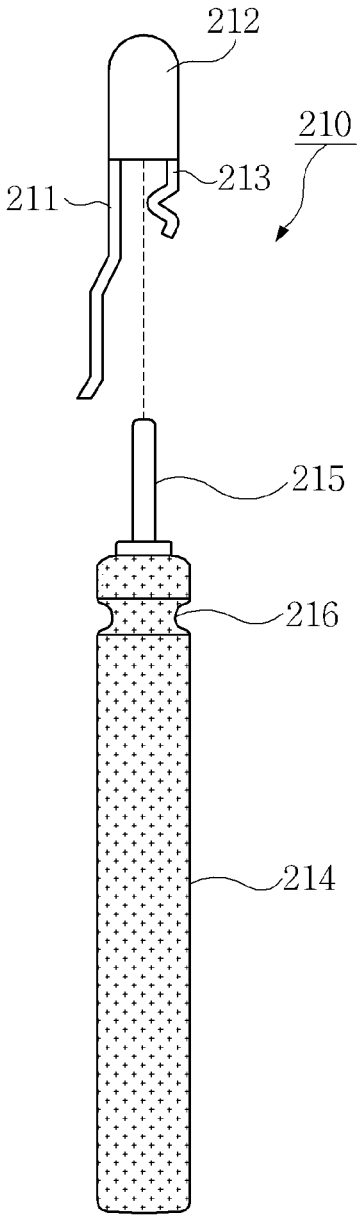
FIG. 8 is a view illustrating a structure of a light emitting portion according to a second embodiment of the present invention.

The light emitting unit 210 has a light 212 and a battery 214 which is separated from the light 212, as illustrated in FIG. 8. Specifically, the battery 214 is formed in a cylinder shape, and has a terminal 215 protruding upwardly from an upper portion thereof. An outer peripheral surface of the cylindrical battery 214 serves as another terminal having polarity different from the terminal 215.

As illustrated in FIG. 8, the light 212 is separated from the battery 214, and has first and second contact terminals 211 and 213. Herein, the first contact terminal 211 is provided to be brought into contact with the outer peripheral surface of the cylindrical battery 214, as illustrated in FIG. 9, while the second contact terminal 213 is moved to be brought into contact with the terminal 215 or to be away from the terminal 215 by the movement of the light operator 230, as illustrated in FIGS. 9 and 10.

Figure 9:
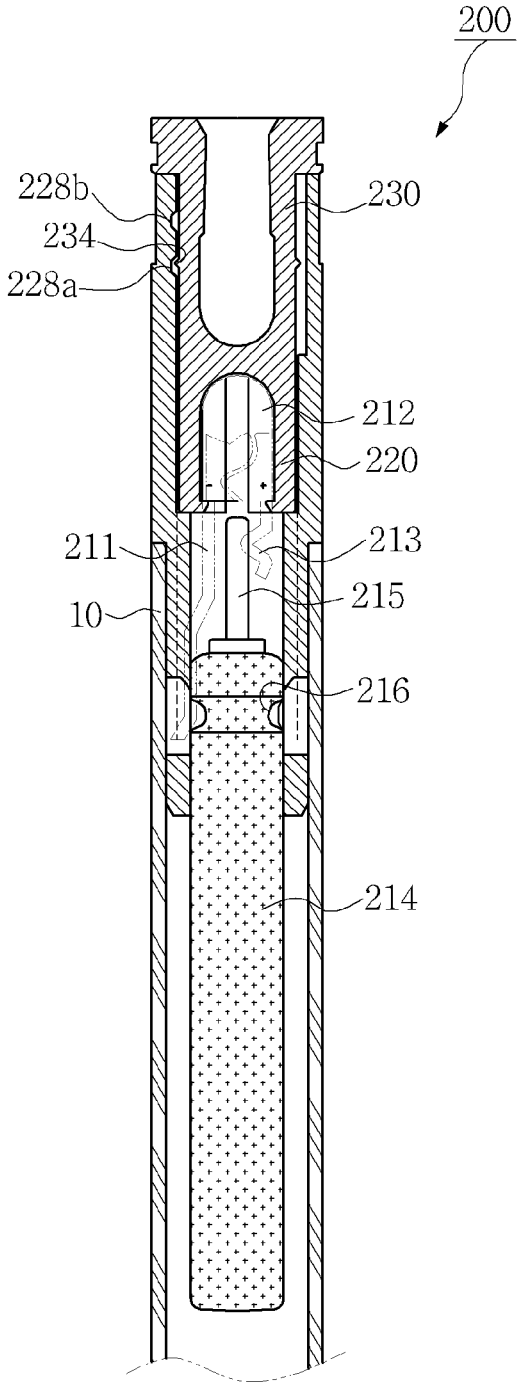
FIGS. 9 and 10 are views illustrating an operating state of the lighted arrow nock according to the embodiment of the present invention.

The light 212 is engaged to a lower portion of the light operator 230, and the battery 214 is engaged to an upper portion of the arrow adaptor 220, as illustrated in FIG. 9. In this instance, if the light operator 230 is engaged to the arrow adaptor 220, the first contact terminal 211 is in contact with the outer surface of the battery 214, while the second contact terminal 213 is in contact with the terminal 215 or is spaced apart from the terminal 215.

As illustrated in FIG. 9, if the light operator 230 is pressed toward the battery 214, the second contact terminal 213 is moved toward the battery 214, and then comes into contact with the terminal 215, so that the light 212 is turned on.

Figure 10:
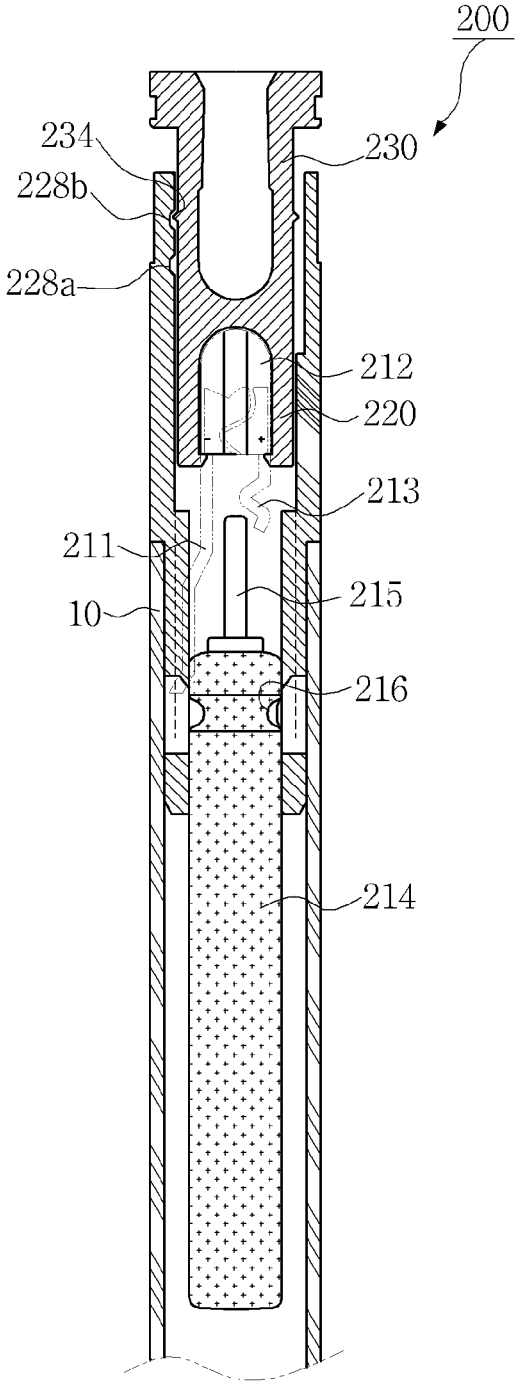

Meanwhile, as illustrated in FIG. 10, if the light operator 230 is moved away from the battery 214, the second contact terminal 213 is also moved away from the battery 214, and then is separated from the terminal 215, so that the light 212 is turned off.

In this embodiment, the configuration and operation of the arrow adaptor 220 and the light operator 230 are substantially equal to those according to the first embodiment, and thus the detailed description thereof will be omitted therein.

While the present invention has been described with reference to the particular illustrative embodiments, it is not to be restricted by the embodiments but only by the appended claims. It is to be appreciated that those skilled in the art can change or modify the embodiments without departing from the scope and spirit of the present invention.

What is claimed is:

1. A lighted arrow nock comprising:

a light emitting unit including a light and a battery and turning on or off the light by moving the light toward the battery or away from the battery;

an arrow adaptor which includes a cylindrical structure so that an outer surface is inserted into a rear end of an arrow, in which the battery is inserted into an inner space of the arrow adaptor; and a light operator which is inserted in an upper portion of the arrow adaptor, while a lower portion of the light operator receives the light, and is moved up and down to turn on or off the light in a state in which the light operator is inserted in the arrow adaptor, wherein the light emitting unit consists of the battery of a cylindrical shape, and the light provided integrally with an upper end of the battery and turned on or off by upward and downward movement of the light operator.

2. The lighted arrow nock according to claim 1, wherein the arrow adaptor includes an arrow engaging portion which has an insertion portion formed on an outer surface of a lower portion of the arrow adaptor and inserted in a rear end of an arrow shaft, and a locking shoulder formed on the outer surface;

a battery insertion hole which is formed in an inner surface of the arrow adaptor and receives the battery therein; and an operator engaging hole which is formed in an inner surface of an upper portion of the battery insertion hole and is engaged to a top surface of the light operator to be able to move up and down.

3. The lighted arrow nock according to claim 2, wherein the arrow engaging portion further includes an arrow insertion reinforcing portion which is formed by cutting a wall of the arrow adaptor, and has a thickness thicker than other wall of the arrow adaptor.

4. The lighted arrow nock according to claim 2, wherein the light operator includes a light insertion groove which is formed on an inner surface of a lower portion of the light operator, so that the light is not easily released from an inserted state;

an adaptor insertion portion which is formed on an outer surface of the light operator and is inserted into the operator engaging hole;

a guide rail which is formed on one side of the adaptor insertion portion to guide the light operator toward the operator engaging hole; and a position restricting portion which is formed at a position opposite to the guide rail of the adaptor insertion portion, and restricts movement of the light operator inserted in the operator engaging hole to ON and OFF positions so as to turn on or off the light.

* * * * *